United States Patent [19]

Todescat et al.

[11] Patent Number: 4,911,619

[45] **Date of Patent: * Mar. 27, 1990**

[54] SUCTION SYSTEM OF HERMETIC REFRIGERATION COMPRESSOR

[75] Inventors: Marcio L. Todescat; Dietmar E. B. Lilie; Helder L. Satler, all of Joinville

[73] Assignee: Empressa Braziliera De Compressores, Brazil

[ * ] Notice: The portion of the term of this patent subsequent to Jul. 5, 2005 has been disclaimed.

[21] Appl. No.: 125,340

[22] Filed: Nov. 25, 1987

Related U.S. Application Data

[63] Continuation-in-part of Ser. No. 34,080, Apr. 2, 1987, Pat. No. 4,755,108.

[30] Foreign Application Priority Data

May 2, 1986 [BR] Brazil ..... PT8602173

[51] Int. Cl.[4] ..... F04B 39/00

[52] U.S. Cl. ..... 417/312; 417/902; 181/403

[58] Field of Search ..... 417/312; 62/296; 181/403, 272, 229, 249, 250

[56] References Cited

U.S. PATENT DOCUMENTS 4,755,108 7/1988 Todescat et al. ..... 417/312

FOREIGN PATENT DOCUMENTS 233383 11/1985 Japan ..... 417/312

*Primary Examiner*—Leonard E. Smith

*Attorney, Agent, or Firm*—Darby & Darby

[57] ABSTRACT

The invention relates to a hermetic refrigeration compressor of the type including a motor compressor unit (1) suspended within a hermetic case (3). The motor compressor unit (1) comprises a cylinder provided with cylinder head (12) defining suction and discharge chambers with their corresponding values, and a suction muffler set (100). According to the invention, the suction muffles set comprises a small muffler shell (110) mounted outside the cylinder head, and an insulating hollow body (120) lining the suction chamber (13) of the cylinder head (12). A strainer device (118) is fixed between the two half parts forming the hollow body (120). This configuration facilitates the assembling of the strainer (118) and guarantees its tight fixation without any kind of fixing frame or ring. This makes it possible to enlarge considerably the area of the strainer, thus avoiding heat transfer from the metal strainer to the suction gas flow when passing throughout the meshes.

3 Claims, 5 Drawing Sheets

SUCTION SYSTEM OF HERMETIC REFRIGERATION COMPRESSOR

This application is a continuation-in-part of application Ser. No. 034,080 filed Apr. 2, 1987 which was resulted in U.S. Pat. No. 4,755,108.

The present invention relates in general to a refrigeration compressor, particularly used in small refrigerating machines.

Hermetic refrigeration compressors consist usually of a motor compressor unit mounted within a hermetically sealed case by means of springs.

These compressors are usually provided with a cylinder and a reciprocating piston which takes in and compresses the refrigerant gas during operation of the electric motor.

Due to the simplicity of construction, these compressors use reed type suction and discharge valves, which cause together with the piston an intermittent flow of refrigerant gas. This intermittent flow of refrigerant gas tends to cause noise, which makes necessary the provision of acoustic dampening systems including mufflers both in the suction and in the discharge line of the compressor.

Though there is a dampening effect of the pulsation of the refrigerant gas, the mufflers act as energy loss sources because they create restrictions to the flow of refrigerant gas that cause pressure losses and reduce, consequently, the compressor efficiency.

In addition to this energy loss, there is the inconvenience of high temperatures generated by the refrigerant gas compression in the cylinder and in the cylinder head causing heat transmission to other metallic parts of the motor compressor unit. These heated metallic parts start irradiating heat, super-heating the refrigerant gas in the suction system of the compressor. This superheating of the refrigerant gas is undesirable because it causes a density decrease of the refrigerant gas which is taken into the cylinder, thus decreasing mass pumped and consequently the efficiency of the compressor.

In the prior art compressors this refrigerant gas superheating is almost always reduced by means of insulating plastic material suction mufflers which are usually mounted away from the metallic parts of the motor compressor unit.

Among the known solutions we mention that of the patent specification U.S. Pat. No. 4,370,104 which shows a suction muffler formed of two pieces of plastic material mounted on the cylinder block. One of these pieces has a cylindrical form with a dome-shaped end. This dome-shaped end is provided with an opening to insert a metallic suction tube, which is connected to the cylinder head.

The other piece, which is also dome-shaped is mounted in the open end of the first piece and has a nozzle that extends towards the suction line of the compressor casing.

Another solution known is that of the patent specification U.S. Pat. No. 4,401,418 in which the suction muffler has an entrance adjacent the suction line of refrigerant and is made of insulating material.

The above-mentioned muffler is attached to the cylinder head by means of two metallic suction tubes extending into the muffler.

Another solution known is that of the patent specification EPO No. 0.073.469 AL which shows a suction muffler system formed of heat resistant plastic and is placed away from the motor compressor unit. The cup-shaped body of the muffler is provided with an opening at its bottom through which extends a communication pipe. This communication pipe has one of its ends supportingly fitted into a suction port of the cylinder head and its other end secured to the opening of the above-mentioned muffler. The connection of the suction muffler to the pipe fixed to the casing is done by means of an insert pipe and a coiled spring. One end of the insert pipe is inserted into an inlet port of the suction muffler and the other into the spring. The spring has its other end connected to the interior projection of the suction pipe.

In spite of reducing the superheating and the pulsation of the refrigerant gas in the suction, the solutions known present deficiencies concerning the energy conservation.

As mentioned before, these suction mufflers have means of throttling and deflecting flow. These means create restrictions to the flow of refrigerant gas in the suction, thus causing pressure losses that reflect on the compressor efficiency.

These solutions still do not prevent the refrigerant gas from being heated in the suction chamber and in the tube(s) which interconnects it with the suction muffler, where very high temperatures occur.

Another deficiency of the known solutions is the absence of a suitable arrangements for placing a strainer device intermediating the suction gas flow. It is to be noticed that strainer devices are commonly used in compressors and provided to keep any solid impurity away from the suction gas flow. Such impurities may be loosened out from the refrigeration system and eventually can penetrate into the interior of the cylinder causing malfunction of the compressor.

It is an object of the present invention to propose a compressor provided with a suction system that can overcome the above-mentioned deficiencies, creating the least possible restrictions to the flow of the refrigerant gas therefore reducing its superheating, enabling an efficiency increase in the compressor.

It is still another object of the invention to disclose a suction muffler system with good attenuation characteristics of the suction noise of the refrigerant gas, without sacrificing the thermal efficiency of the compressor.

Still another object of the present invention is to provide a proper arrangement for placing a strainer device inside the compressor case facilitating assembling and air-tightness of the compressor.

These and other objects and advantages of the invention are attained in a compressor of the type that integrates a motor compressor unit suspended within a hermetic case having suction and discharge pipes and including: a cylinder block supporting the motor comprising at least a discharge muffler connected to the cylinder which is provided with a cylinder head defining discharge and suction chambers within which are mounted the discharge and suction valve, this suction chamber being provided with an opening for intaking gas; and a suction muffler set. According to the present invention the suction muffler set is comprised of: basically a muffler portion with the shape of a small hermetic shell mounted outside the cylinder head which has at least an internal chamber and is provided with a gas inlet opening arranged in such a form that receives the gas flow of the suction pipe, and a gas outlet opening; a flow leading pipe inside the small shell, interconnecting the gas inlet and outlet openings and provided with at least a radial opening that communicates the pipe inside with the inside of each chamber and an insulating portion with the shape of a hollow body lining the inside of the suction chamber and that is provided with an inlet nozzle disposed at the inlet opening of the mentioned suction chamber and tightly connected to the end of the flow leading pipe outlet. This hollow body still has an outlet opening which is in fluid communication with the suction valve of the compressor.

According to the present invention the suction gas is taken in and led through the inside of the suction muffler set with a minimum of turbulance. The main flow of refrigerant gas is led through the whole muffler set without undergoing throttling or sudden deviations of direction.

The attenuation of the gas pulsation is done by the simultaneous action of the flow leading pipe and the inside chamber(s) of the muffler set.

In terms of an analogous electric system, the action of the flow leading pipe is analogous to that of an inductor, whereas the action of the chamber(s) is analogous to that of capacitors.

In a such system the attenuation of the sound energy of the pressure waves is not due to the absorption effect but rather to partial reflection to the source (cylinder head).

The reduction of the superheating of the suction gas is obtained by insulating the whole suction system including each muffler chamber, the suction chamber and the interconnecting duct(s).

The radial openings of the flow leading pipe communicating its inside which each muffler chamber act acoustically as section changes without creating troubles of pressure drop which occur in known compressors and affect their efficiency.

In a preferred embodiment, the flow leading pipe is provided at its inlet end with a nozzle of rectangular cross sectional area that makes easy the intake of refrigerant gas from the suction pipe to the inside of the suction muffler set.

The invention will be described now with reference to the attached drawings, in which.

Figure 1:
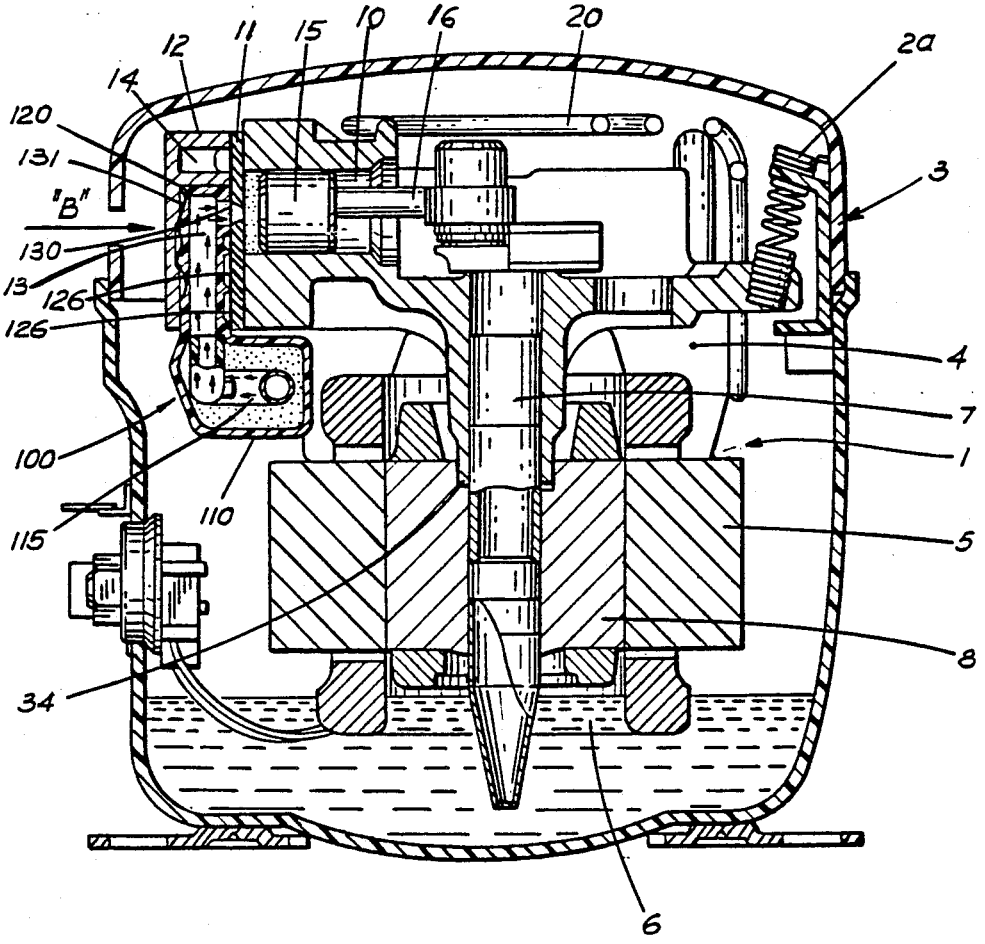
FIG. 1 shows a front sectional view at a compressor according to the present invention.
Figure 2:
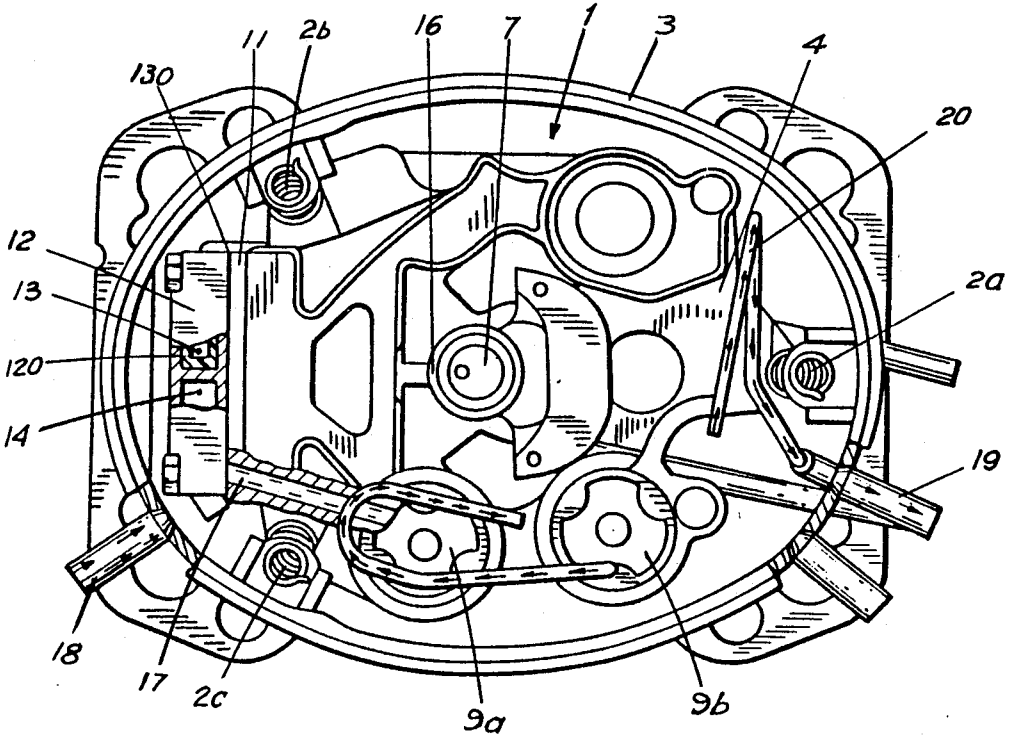
FIG. 2 shows a top plan view of the compressor illustrated in FIG. 1, with the upper casing removed.

According to the above-mentioned figures the motor compressor unit 1 is suspended by means of the coil springs 2*a*, 2*b* and 2*c* within the hermetic case 3. A cylinder block 4 supports a stator 5 of an electric motor 6 and embodies a bearing 34 for a crankshaft 7 secured to a rotor 8 of the electric motor 6.

Figure 3:
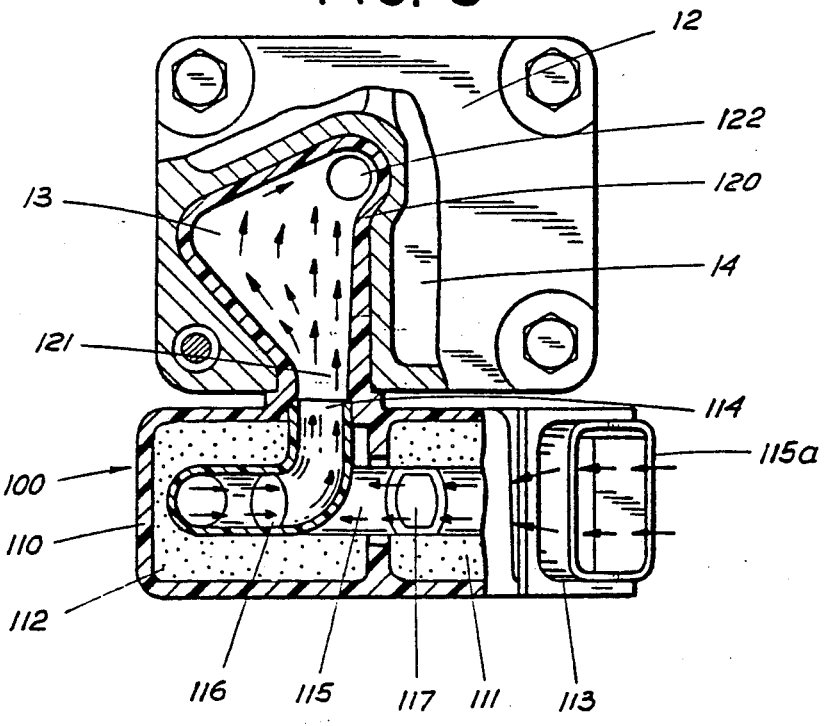
FIG. 3 shows a fragmentary sectional view of the cylinder head and the suction system of the compressor illustrated in FIG. 1 taken according to the direction "B"
Figure 4:
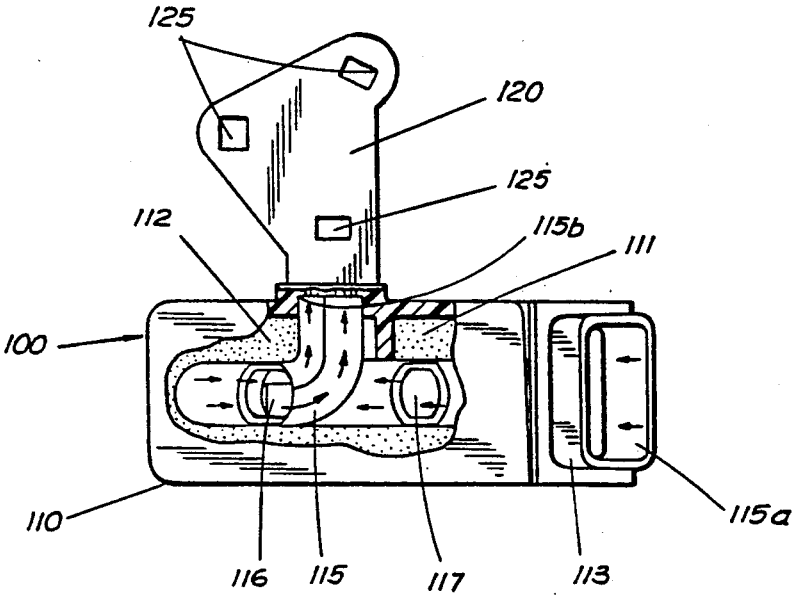
FIGS. 4 and 5 show respectively the front and top view of the suction muffler system and the suction chamber insulation.
Figure 5:
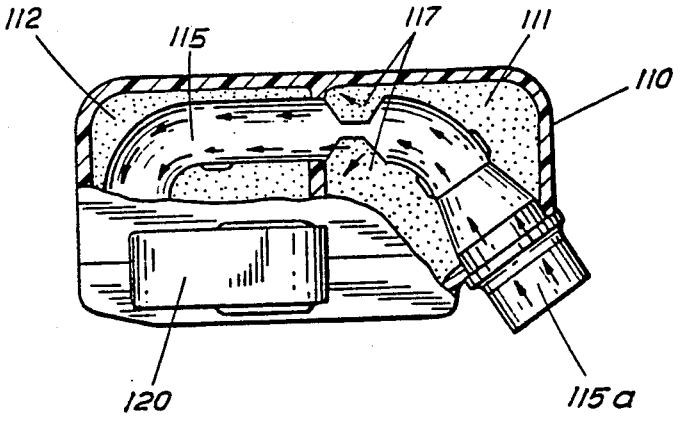

The cylinder block 7 embodies also the pulsation muffler chambers 9*a* and 9*b* of the discharge gas and a cylinder 10 in which are fastened a valve plate 11 and a cylinder head 12. The cylinder head 12 is provided with two internal cavities which are opened to its face adjacent the valve plate 11 and define the suction 13 and the discharge chamber 14 as illustrated in the FIG. 3. In the cylinder inside 10 is mounted a piston 15 which is driven by the crankshaft 7 through the connecting rod 16. The cylinder block 4 still has an internal channel 17 interconnecting the discharge chamber 14 formed in the cylinder head 12 to the discharge muffler 9*a*.

The hermetic case 3 also supports a suction 18 and a discharge pipe 19. A flexible pressure pipe 20 has one of its ends connected to the discharge pipe 19 and the other to the discharge muffler 9*b*.

As illustrated in the FIGS. 1, 3, 4 and 5, the suction muffler set 100 comprises a pulsation muffler portion 110 and a thermal insulating portion 120.

The muffler portion 110 has the shape of a small hermetic shell mounted outside the cylinder head 12, at a slight distance from it and forms at least an internal chamber. In the embodiment illustrated, the small hermetic shell 110 defines two internal chambers 111 and 112, the first one 111 being provided with a gas inlet opening 113 whereas the second chamber 112 is provided with a gas outlet opening 114.

Inside the small shell 110 is mounted a flow leading pipe 115 interconnecting the outlet 114 with the inlet opening 113 of gas in the muffler portion or small shell 110. The mentioned flow leading pipe 115 has an enlarged inlet end forming a nozzle 115*a* with rectangular cross sectional area. This nozzle 115*a* is tightly fitted and extending outwards from the gas inlet opening 113 of the small shell 110, in such a manner to stay aligned and adjacent to the suction pipe 18 of the hermetic case 3 of the compressor.

The flow leading pipe 115 is provided with radial openings 116 and 117 placed in the inside of the muffler chambers 112 and 111 and has its outlet 115*b* tightly connected to the gas outlet opening 114 of the small shell 110.

An important feature related to the compressor efficiency refers to the spacing between the wall of the flow leading pipe 115 and the wall of the small shell 110. This spacing creates convective resistances between the (external) surface of the flow leading pipe 115 and the (internal) surface of the small shell 110. These convective resistances added to the conductive resistance of the insulation wall reduce considerably the heat flow and consequently the superheating of the suction gas, resulting in an efficiency increase of the compressor.

The thermal insulating portion 120 aims at reducing even more the heat transfer to the refrigerant gas in the suction chamber and has the shape of a hollow body formed so as to line internally the suction chamber 13 of the cylinder head 12. The thermal insulating section 120 is provided with a gas inlet nozzle 121 disposed at the gas inlet opening of suction chamber 13 of the cylinder head 12. The gas inlet nozzle 121 is tightly connected to the gas outlet opening 114 of the second chamber 112 and to the outlet 115*b* of the flow leading pipe 115, the hollow body 120 also has a gas outlet opening 122 in communication with the suction valve.

The small shell 110 and the hollow body 120 are made of thermal insulating material, preferably of plastics compatible with the refrigerant gas and lubricating oil used in the compressor.

In the preferred embodiment the small shell 110 forms one single body with the hollow body 120, and the suction muffler set is formed by these two portions and also by the flow leading pipe 115. This flow leading pipe 115 consists of a single piece with two parts, which are mounted by means of suitable recesses made along its edges. The two halves which form the small shell 110 and the hollow body 120 should be welded after fitting by ultra sound process so as to form a hermetic piece.

In the above-mentioned construction the small shell 110 remains suspended by the nozzle 121 of the hollow body 120 which extends outwards from the cylinder head 12 being no contact between the small shell 110 and the cylinder 10 of the compressor.

Figure 6:
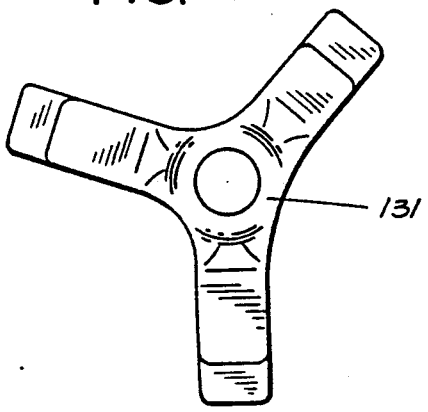
FIG. 6 shows a top view of the compression spring of the suction chamber insulating portion.

As illustrated in FIG. 1 the insulating section or hollow body 120 of the suction chamber 13 is provided with a gasket system consisting of a spring 131 and a flat gasket 130. The spring 131, illustrated in FIG. 6 is mounted between the cylinder head 12 and the insulating portion 120 of the suction chamber 13 and exerts pressure on three points defined by the recesses 126 of the upper surface of the mentioned insulating portion 120 of the suction chamber 13. The spring 131 aims at assuring the compression of the gasket 130 by absorbing dimensional deviations and possible thermal expansions which might cause emission of noise and oil leakage through the clearances existing among the cavity of the cylinder head or cover 12 of the cylinder 10 and the gas outlet opening 122 insulating portion 120 of the suction chamber 13.

Figure 7:
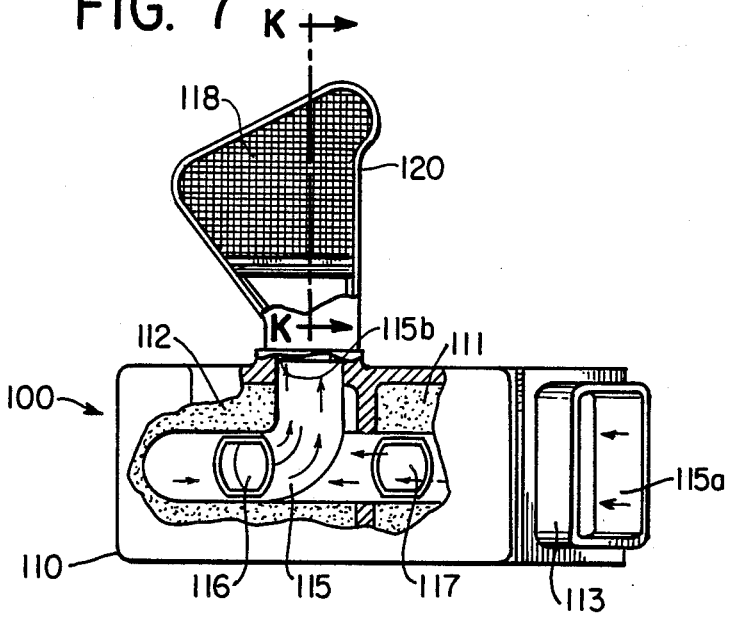
FIG. 7 is a front sectional view of the suction muffler system and suction chamber insulation showing the strainer device.
Figure 8:
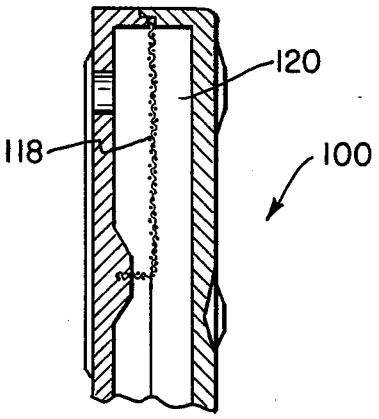
FIG. 8 is an enlarged, fragmentary cross-sectional view taken on line KK of FIG. 7.

As shown in FIGS. 7 and 8 the strainer device (118) is fixed between the two half parts to form the hollow body (120). This configuration facilitates the assembling of the strainer (118) and guarantees its tight fixation without any kind of fixing frame or ring as normally used by prior art.

An important feature of this assembly is that it makes possible to enlarge considerably the area of the strainer, thus avoiding heat transfer from the metal strainer to the suction gas flow when passing throughout the meshes, as it often happens in the known solutions.

Still an advantage of the present design is that the strainer (118) is placed inside the plenum of the suction chamber (13) helping to stabilize the suction gas flow and even more decreasing its pressure pulsation.

A constructive aspect that should be pointed out is that the wall of the hollow body 120 having the gas outlet opening 122 is slightly lowered or drawn away so as to maintain a small distance 126 from the adjacent wall of the suction chamber 13 after its mounting on the valve plate 11. This spacing has the purpose of creating an additional thermal resistance between the metallic surface and the insulating material, reducing even more the flow of heat to the suction gas.

The flow of refrigerant gas inside the compressor is represented by means of arrows in the FIGS. 1, 2, 3 and 4.

The refrigerant gas which is taken into the inside of the compressor case 3 through the suction pipe 18 is conducted directly to the suction muffler set 100 through the nozzle 115A with rectangular cross sectional area.

When refrigerant gas is taken into the suction muffler set 100 it is led through the flow leading pipe 115 undergoing the action of the muffler chambers 111 and 112 with which the flow leading pipe 115 communicates through the radial openings 117 and 116.

Following its course, the refrigerant gas passes from the suction muffler set 100 to the suction chamber 13 in the cylinder head 12 and is then taken into the cylinder 10 where it is compressed.

After being compressed, refrigerant gas flows into the discharge chamber 14 also in the cylinder head 12 and is led through the channel 17 to the pulsation muffler chambers 9A and 9B of the discharge gas, which are interconnected. In the final stage, refrigerant gas is led from these chambers to the discharge pipe 19 through the pressure pipe 20.

The suction system so described allows an obtaining of considerable efficiency increase in the compressor allied to good results relating to noise of suction.

We claim:

1. A suction system of hermetic refrigeration compressor comprising a motor compressor unit suspended within a hermetic case having suction and discharge pipes, a cylinder block having at least one cylinder, a discharge muffler connected to the cylinder, the cylinder being provided with a cylinder head defining suction and discharge chambers receiving suction and discharge valves, a suction muffler set, said muffler set comprises a muffler portion having a shape of a small hermetic shell mounted outside the cylinder head, the muffler portion having at least one internal chamber provided with a gas inlet opening arranged to receive the gas flow of the suction pipe and having a gas outlet opening, a flow leading pipe situated inside the small shell interconnecting the gas inlet and outlet and provided with at least one radial opening for communication of the pipe with an interior of said internal chamber, an insulating portion having a shape of a hollow body providing a lining within the interior of the suction chamber and said insulating portion having an inlet nozzle disposed at the inlet opening of the suction chamber and tightly connected to the outlet end of the flow leading pipe, said hollow body also having an outlet opening communicating with the suction valve in the cylinder head, a strainer device is placed inside the hollow body dividing its interior in two parts which are penetrated by a gas flow entering the suction valve of the cylinder head.

2. A suction system of hermetic refrigeration compressor according to claim 1, wherein a substantial part of said strainer device is placed substantially parallel to cylinder head walls to increase an area of passage of flow through said strainer device.

3. A suction system of hermetic refrigeration compressor according to claim 2, wherein said strainer device is fixed between welded halves of said hollow body.

* * * * *

UNITED STATES PATENT AND TRADEMARK OFFICE

CERTIFICATE OF CORRECTION

PATENT NO. : 4,911,619

DATED : March 27, 1990

INVENTOR(S) : MARCIO L. TODESCAT, ET AL.

It is certified that error appears in the above-identified patent and that said Letters Patent is hereby corrected as shown below:

ON THE COVER SHEET OF THE PATENT,

Item NO. [30]- THERE IS A TYPOGRAPHICAL ERROR IN THE PRIORITY NUMBER. THE NUMBER SHOULD READ --PI8602173-- and NOT "PT8602173".

Signed and Sealed this

Twenty-ninth Day of October, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,911,619

DATED : March 27, 1990

INVENTOR(S) : MARCIO L. TODESCAT, ET AL.

It is certified that error appears in the above-identified patent and that said Letters Patent is hereby corrected as shown below:

ON THE TITLE PAGE, ITEM [73]:

THE NAME OF THE ASSIGNEE IS SPELLED INCORRECTLY. THE CORRECT SPELLING IS --EMPRESA BRASILEIRA DE COMPRESSORES S.A. EMBRACO--

Signed and Sealed this

Fifth Day of January, 1993

*Attest:*

*Attesting Officer*

DOUGLAS B. COMER

*Acting Commissioner of Patents and Trademarks*

UNITED STATES PATENT AND TRADEMARK OFFICE

CERTIFICATE OF CORRECTION

PATENT NO. : 4,911,619

DATED : March 27, 1990

INVENTOR(S) : MARCIO L. TODESCAT et al.

It is certified that error appears in the above-identified patent and that said Letters Patent is hereby corrected as shown below:

On the title page, Delete;

"Assignee: Empressa Braziliera De Compressores" and substitute therefor --Empresa Brasileira de Compressores S/A - EMBRACO--.

Signed and Sealed this

Thirteenth Day of September, 1994

*Attest:*

*Attesting Officer*

Bruce Lehman

BRUCE LEHMAN

*Commissioner of Patents and Trademarks*